United States Patent [19]

Brüstle et al.

[11] Patent Number: 5,056,189

[45] Date of Patent: Oct. 15, 1991

[54] HINGE WITH TIGHT FIT BETWEEN BASE PLATE AND ADAPTER

[75] Inventors: Klaus Brüstle; Helmut Rupprechter, both of Lauterach; Lother Prager, Lustenau, all of Austria

[73] Assignee: Julius Blum Gesellschaft m.b.H., Höchst, Austria

[21] Appl. No.: 490,586

[22] PCT Filed: Aug. 26, 1988

[86] PCT No.: PCT/AT88/00067

§ 371 Date: Feb. 28, 1990

§ 102(e) Date: Feb. 28, 1990

[87] PCT Pub. No.: WO89/02022

PCT Pub. Date: Mar. 9, 1989

[30] Foreign Application Priority Data

Aug. 31, 1987 [AT] Austria ..... 2178/87
Aug. 31, 1987 [AT] Austria ..... 2179/87

[51] Int. Cl.[5] ..... E05D 07/04

[52] U.S. Cl. ..... 16/235; 16/258; 16/238; 16/DIG. 43

[58] Field of Search ..... 16/257, 258, 238, 236, 16/DIG. 43, 235

[56] References Cited

U.S. PATENT DOCUMENTS 4,800,621 1/1989 Röck et al. ..... 16/235
4,800,622 1/1989 Röck et al. ..... 16/DIG. 43 X

FOREIGN PATENT DOCUMENTS 1522807 8/1978 United Kingdom ..... 16/235
2189837 11/1987 United Kingdom ..... 16/238

*Primary Examiner*—Richard K. Seidel
*Assistant Examiner*—Patty E. Hong
*Attorney, Agent, or Firm*—Wenderoth, Lind & Ponack

[57] ABSTRACT

A hinge with an adjusting system includes a hinge arm that can be secured to a base plate by at least one adapter. The hinge arm has holes through which pass adjusting and attachment screws. The adapter can be installed on the base plate and can be locked by means of a rocker lever supported on the adapter so as to be able to swivel. The adapter is U-shaped and has two side arms that enclose the base plate and the sides thereof. Both side arms of the adapter lie with no clearance on the base plate, and the material of at least one of the side arms is weakened at at least one place. The adapter is installed at the front by a cross pin thereof fitting in a notch in the base plate. The shape of the notch corresponds to that of the cross pin, and the cross pin is accommodated without any play within the notch. The generators or the center or mid-line longitudinal axes of the notch and the cross pin extend unstressed at an angle relative to each other.

5 Claims, 3 Drawing Sheets

HINGE WITH TIGHT FIT BETWEEN BASE PLATE AND ADAPTER

BACKGROUND OF THE INVENTION

The present invention relates to a furniture hinge with an adjusting system, in which a hinge arm can be secured by means of at least one adapter to a base plate and is connected by means of a hinged lever or the like to a second hinge component, for example, a hinge casing in a furniture door, the hinge arm having holes through which adjusting and/or attachment screws protrude, and the adapter being installable on the base plate and lockable by means of a rocker lever supported on the adapter so as to be able to swivel, the adapter being U-shaped and having two side arms that enclose sides of the base plate.

In conventional hinges, the hinge arm is secured to the base plate by means of a clamping screw, which generally protrudes through a slot so as to make it possible to adjust the hinge arm in the direction of the depth of the article of furniture.

Recently, snap connections for fastening a hinge arm to a base plate have been disclosed. For example, DE-A-30 26 796 and 30 39 328 describe hinges with a hinge arm and an attachment plate, in which by inserting the hinge arm in a guide in the attachment plate and moving this in a longitudinal direction the two parts that are to be locked to one another snap together. A similar attachment of a hinge arm on a base plate is described in DE-A-24 60 127. DE-A-32 41 284 describes a hinge wherein a hinge arm can slide into side guides in a base plate and can be clamped onto the base plate by means of an eccentric clamp.

The hinge arm attachments described above provide the advantage that the hinge arm can be secured very rapidly to the base plate when the article of furniture is being assembled, and that in addition no tools are required for assembly. This advantages should not be underestimated, since the door has to be held when the hinge arm is being installed. If, for example, the door is being held with one hand and the hinge arm that is to be installed is held with the other, then if the hinge arm is locked by means of a clamping screw, it is in many cases necessary to have a helper who can tighten the clamping screw with a screwdriver.

A disadvantage of the hinges in which the hinge arm or the adapter slides into the base plate from the front is that they are easily tilted. This is particularly true of tall or high doors that are fitted with many hinges.

AT-PS 360 865 proposes a hinge in which the adapter can be installed at the end of a base plate and which, at the other end, has a rocker lever by means of which the base plate can be locked.

SUMMARY OF THE INVENTION

An object of the present invention is to provide a hinge of this type, but wherein there is no play between the adapter and the base plate.

According to the invention this is achieved in that both side arms of the adapter lie on the base plate with no play or with negative tolerance so that the adapter must be pressed onto the base plate, and that at least one of the side arms is weakened at at least one place or portion thereof. With this construction, it is possible to keep the distance between the two arms of the adapter very small. The weakening of the material prevents the necessity of large installation forces when the adapter is pressed onto the base plate with a clamping effect. It is advantageous that the material be weakened by forming a slot therein. Advantageously, it is also provided that the slot extends in a longitudinal direction of the adapter at a location in the vicinity of the rocker lever.

The seating of the adapter on the base plate is achieved in accordance with a further feature of the invention by positioning a cross pin of the adapter in a notch in the base plate, the adapter enclosing the base plate with both its side arms such that there is no free play. The generators or the mid-line or center longitudinal axes of the notch and the pin extends, in an untensioned state, at a shallow angle of preferably 1° to each other. As a result, the adapter is caused to twist and is held on the base plate by internal stress. This arrangement makes it possible to achieve a stress between the adapter and the base plate as a consequence of twisting of the adapter.

BRIEF DESCRIPTION OF THE DRAWINGS

The present invention will now be described in more detail, by way of example only, with reference to the accompanying drawings, wherein.

DETAILED DESCRIPTION OF THE INVENTION

Figure 1:
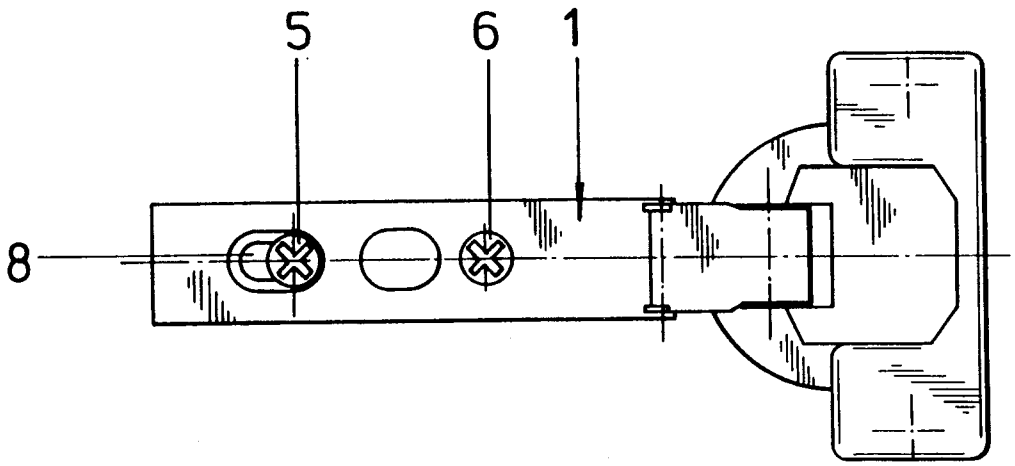
FIG. 1 is a plan view of a hinge according to the present invention.
Figure 2:
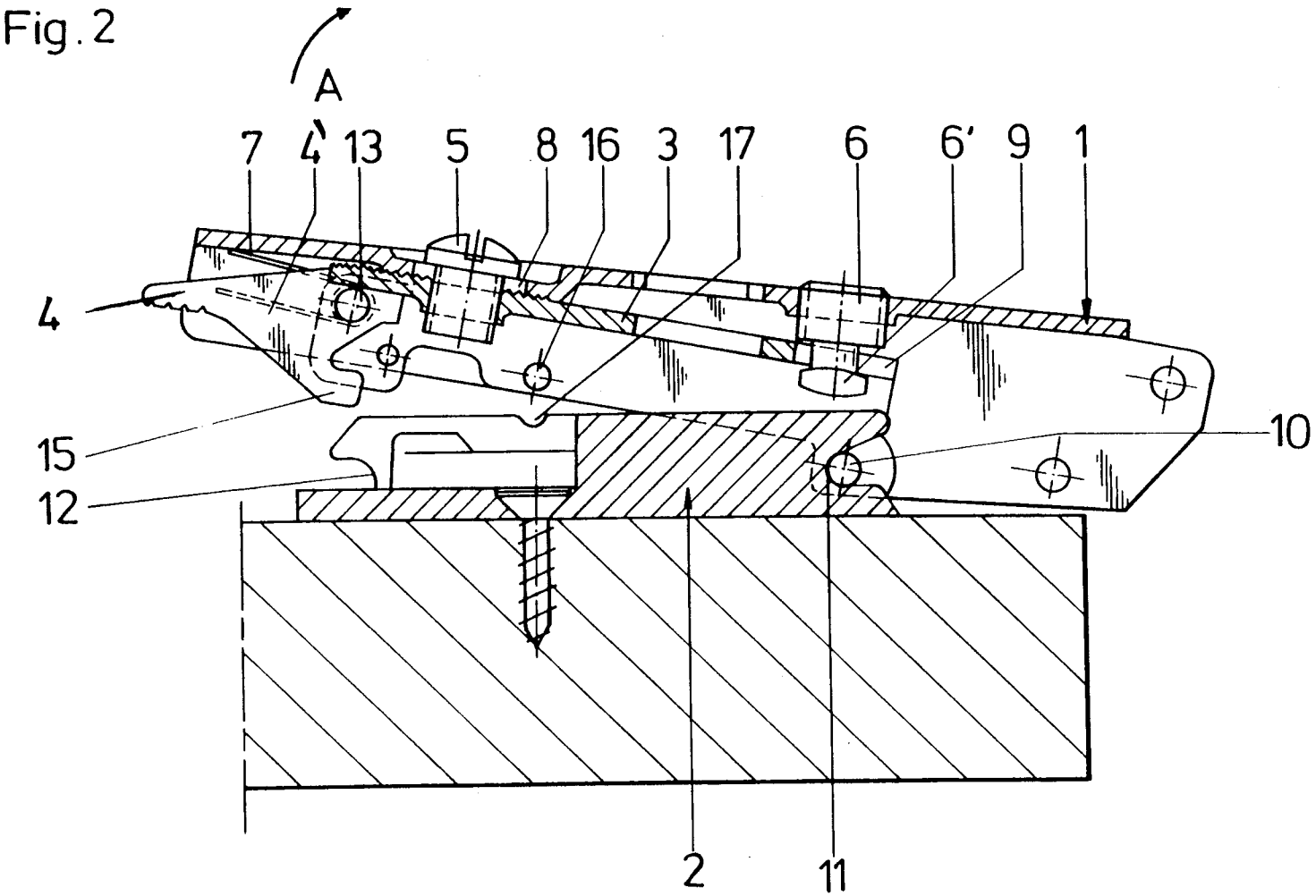
FIG. 2 is a longitudinal section through a hinge arm and a base plate shown in a position wherein the hinge arm is being installed.
Figure 3:
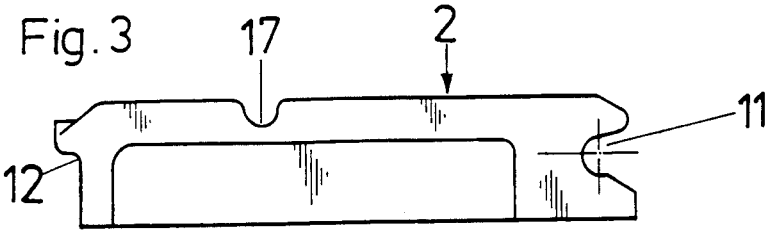
FIG. 3 is a side view of the base plate.
Figure 4:
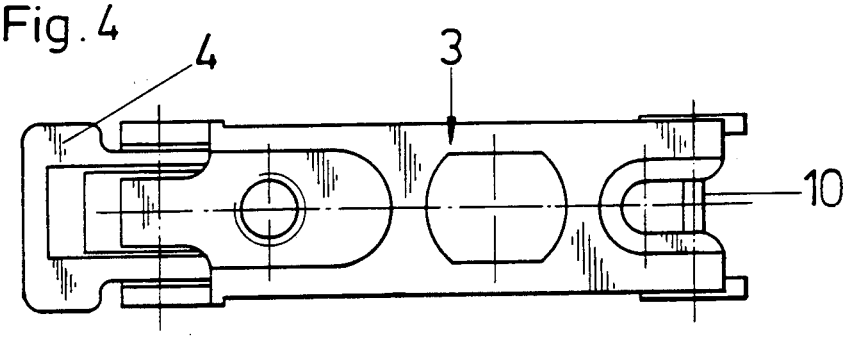
FIG. 4 is a plan view of an adapter.

As can be seen from the drawings, the parts of the hinge that are essential to the present invention are a hinge arm 1, a base plate 2, and an adapter or intermediate member 3 with a rocker lever 4.

The hinge arm 1 is secured to the adapter 3 by means of a gap-adjusting screw 6 that is supported in a female thread in the hinge arm 1, and by means of a clamp screw 5, which also serves as a depth adjusting member. The clamp screw 5 passes through a longitudinal slot 8 in the hinge arm 1 and the gap-adjusting screw 6 is also held in a longitudinal slot 9 in the adapter 3 by a head 6' of screw 6. The hinge arm 1 can be moved along the length of the slot 8 by loosening the clamping screw 5, and thereby can then be correctly set in the direction of the depth of the article of furniture. Adjustment in the direction of the furniture door joint is effected in the usual manner, by rotating the gap-adjusting screw 6.

Both the base plate 2 and the adapter 3 are made so as to be of U-shaped cross-section. At the front, the adapter 3 has a transverse through pin 10 that serves as a holding projection of the adapter 3. The base plate 2 has a notch 11 at the front, and the pin 10 can be installed in notch 11, so that it is held on the base plate 2. The base plate 2 also has a similar notch 12 at the rear end. The rocker lever 4 is supported by a stud 13 at the rear end of the adapter 3. A hook portion 15 is formed on the rocker lever 4. The rocker lever 4 is acted on by a spring 7, one end of which rests on the hinge arm 1. In the embodiment shown, the spring 7 is a leg spring.

If the hinge arm 1 with the adapter 3 are pressed onto the base plate 2 from the position that is shown in FIG.

2, a retaining projection or hook 15 of the rocker lever 4 snaps into the notch 12 and the hinge arm 1 is anchored on the base plate 2. Should it be necessary, the hinge arm 1 is adjusted in the manner described heretofore. A grip portion 4' is formed on the rocker 4. If the hinge arm 1 is to be released from the base plate 2, it is sufficient to raise grip portion 4', whereupon the retaining projection 15 snaps out of the notch 12 and the hinge arm 1 with the adapter 3 can be raised from the base plate 2.

In order to ensure a snug fit of the unit made up of the hinge arm 1 and the adapter 3 on the base plate 2 in the longitudinal direction of the hinge arm 1, the adapter 3 is fitted with a transverse pin 16 that snaps into a notch 17 in the base plate 2. The positioning of the adapter 3 and thus of the hinge arm 1 relative to base plate 2 is effected by the pin 10 and the pin 16.

Figure 5:
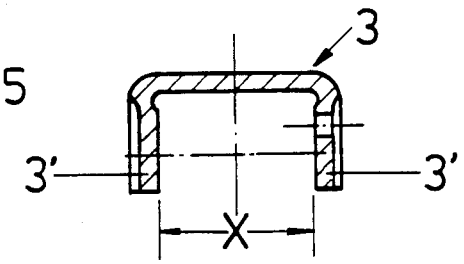
FIG. 5 is a transverse sectional view of the adapter.
Figure 6:
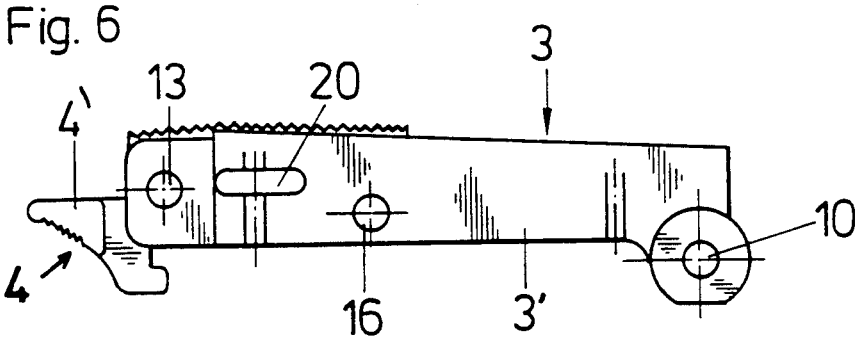
FIG. 6 is a side view of the adapter.
Figure 7:
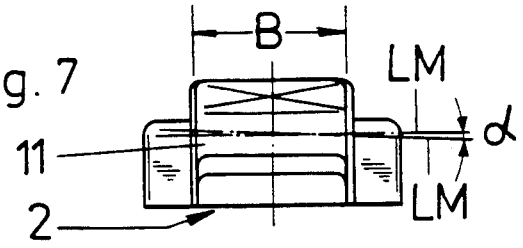
FIG. 7 is an end view of the base plate.

Because of this configuration, all that is required of the rocker lever 4 is that it prevent the hinge arm 1 from being lifted from the base plate 2 in the direction indicated by the arrow A, which means that it only has to be able to withstand small forces. Larger forces that act in the longitudinal direction of the adapter 3 are absorbed by the shape fit between the pin 16 and the notch 17. Of course, when the hinge arm 1 is installed, the greatest forces act transversely to the longitudinal direction of the hinge arm 1. For this reason, it is extremely important that there is no lateral free play between the adapter 3 and the base plate 2. To this end, the clearance of spacing, marked X in FIG. 5, between two side arms 3' of the adapter 3 is to be kept very small relative to the width B of the base plate 2, or there is to be a slight negative tolerance so that it is necessary to push the adapter 3 onto the base plate 2, such that there is generated a lateral force component that acts on the side arms 3'.

In order to prevent the installation pressure from being too great, according to the present invention provision is made to ensure that one of the two side arms 3' of the adapter 3 has a longitudinal slot 20. This longitudinal slot 20 extends in the longitudinal direction of the adapter 3 at a location at the rear end of the adapter 3, i.e., close to the rocker lever 4.

In order to achieve additional tightening, the generator or the longitudinal mid-line or center axis of the notch 11 is inclined to that of the pin 10. The angle of this inclination is very small, and in the embodiment shown amounts to 1°. Of course, it is of no consequence whether the notch 11 or the pin 10 is oriented at a slight inclination or parallel to the plane of installation. All that is important is the angle between the axes of the two elements, i.e. of pin 10 and notch 11. In principle, what is involved here is a theoretical angle since, upon assembly, the pin 10 is installed and fits in the notch 11 and is thus held therein. However, this causes the adapter 3 to twist when it is installed on the base plate 2 in order that its side arms 3' can enclose the base plate properly. The twist that is generated in the adapter due to the inclination of the axes of the notch 11 and the pin 10 generates tension that ensures that the adapter 3 is firmly seated on the grips the base plate 2.

We claim:

1. In a hinge including a base plate having first and second longitudinally spaced ends, opposite sides, a transverse notch formed in said first end and latching means formed at said second end, a hinge arm, an adapter adjustably supporting said hinge arm for mounting said hinge arm on said base plate and having first and second longitudinally spaced ends, said adapter having U-shaped configuration including opposite, longitudinally extending side arms, a transverse pin extending between said side arms at said first end of said adapter, said pin fitting in said notch in said first end of said base plate and thereby forming a pivot about which said adapter and said hinge arm are pivotable with respect to said base plate, and a rocker lever mounted at said second end of said adapter for engaging said latching means at said second end of said base plate when said adapter and said hinge arm are pivoted about said pivot toward said base plate, thereby fastening said adapter to said base plate, the improvement comprising means for ensuring that said adapter fits tightly on said base plate without transverse or lateral play therebetween, said ensuring means comprising:

inner surfaces of said side arms of said adapter being spaced from each other in an unstressed state by a first distance less than a second distance between outer surfaces of said opposite sides of said base plate, and at least one of said side arms having a weakened area enabling said at least one side arm, upon said adapter being pivoted toward said base plate, to deform laterally outwardly, such that said inner surfaces of said side arms of said adapter tightly grip said outer surfaces of said sides of said base plate; and said transverse pin and said notch having respective longitudinal center axes extending in an untensioned state at an angle to each other, such that upon said transverse pin being fit into said notch to conform thereto said adapter is twisted, thereby causing said inner surfaces of said side walls to further grip said outer surfaces of said sides.

2. The improvement claimed in claim 1, wherein said weakened area of said at least one side arm comprises a slot formed therein.

3. The improvement claimed in claim 2, wherein said slot is elongated in a direction between said first and second ends of said adapter.

4. The improvement claimed in claim 2, wherein said slot is located adjacent said rocker lever at said second end of said adapter.

5. The improvement claimed in claim 1, wherein said angle is approximately 1°.

* * * * *